US006488246B2

(12) United States Patent
Song

(10) Patent No.: US 6,488,246 B2
(45) Date of Patent: Dec. 3, 2002

(54) WIRE TYPE APPARATUS FOR HANGING VACUUM CLEANER

(75) Inventor: Young-So Song, Seoul (KR)

(73) Assignee: Conet Industries, Inc., Seoul (KR)

( * ) Notice: Subject to any disclaimer, the term of this patent is extended or adjusted under 35 U.S.C. 154(b) by 0 days.

(21) Appl. No.: 09/824,410

(22) Filed: Apr. 2, 2001

(65) Prior Publication Data

US 2002/0113179 A1 Aug. 22, 2002

(30) Foreign Application Priority Data

Feb. 16, 2001 (KR) ..... 01-7659

(51) Int. Cl.[7] ..... F16M 11/00
(52) U.S. Cl. ..... 248/175; 248/302
(58) Field of Search ..... 248/302, 175; 211/106, 13.1, 70.6

(56) References Cited

U.S. PATENT DOCUMENTS 4,387,811 A * 6/1983 Ragir et al. ..... 211/119
4,598,891 A * 7/1986 Hanert ..... 248/302
4,893,770 A * 1/1990 Bajak et al. ..... 248/117.1
4,895,334 A * 1/1990 Bajek et al. ..... 248/302
5,143,228 A * 9/1992 Arnold ..... 211/70.6
5,588,543 A * 12/1996 Finger ..... 211/90
5,620,105 A * 4/1997 Macek ..... 211/119
6,065,727 A * 5/2000 Fitzgerald et al. ..... 248/302
6,299,001 B1 * 10/2001 Frolov et al. ..... 211/106

* cited by examiner

*Primary Examiner*—Ramon O. Ramirez
*Assistant Examiner*—Kofi Schulterbrandt
(74) *Attorney, Agent, or Firm*—R. Neil Sudol; Henry Coleman; William Sapone

(57) ABSTRACT

The present invention relates to a wire type apparatus for hanging a vacuum cleaner capable of easily storing a vacuum cleaner and other parts of the same. The wire type apparatus for hanging a vacuum cleaner according to the present invention includes a main wire having a wall hanged clip at a certain portion and forming a body by bending a wire and including a wrinkled pipe hanging member for hanging a wrinkled pipe at a lower portion, a skirt wire welded to a certain portion of the main wire and forming a certain space for receiving a surrounding portion of the vacuum cleaner by bending the wire, a support wire for supporting the skirt wire and a lower portion of the suction port at a lower portion of the skirt wire, and a connection pipe hanging member having an end portion connected to a reinforced wire of the main wire and connected with the hanging member for supporting the connection pipe.

17 Claims, 2 Drawing Sheets

【Fig.1】
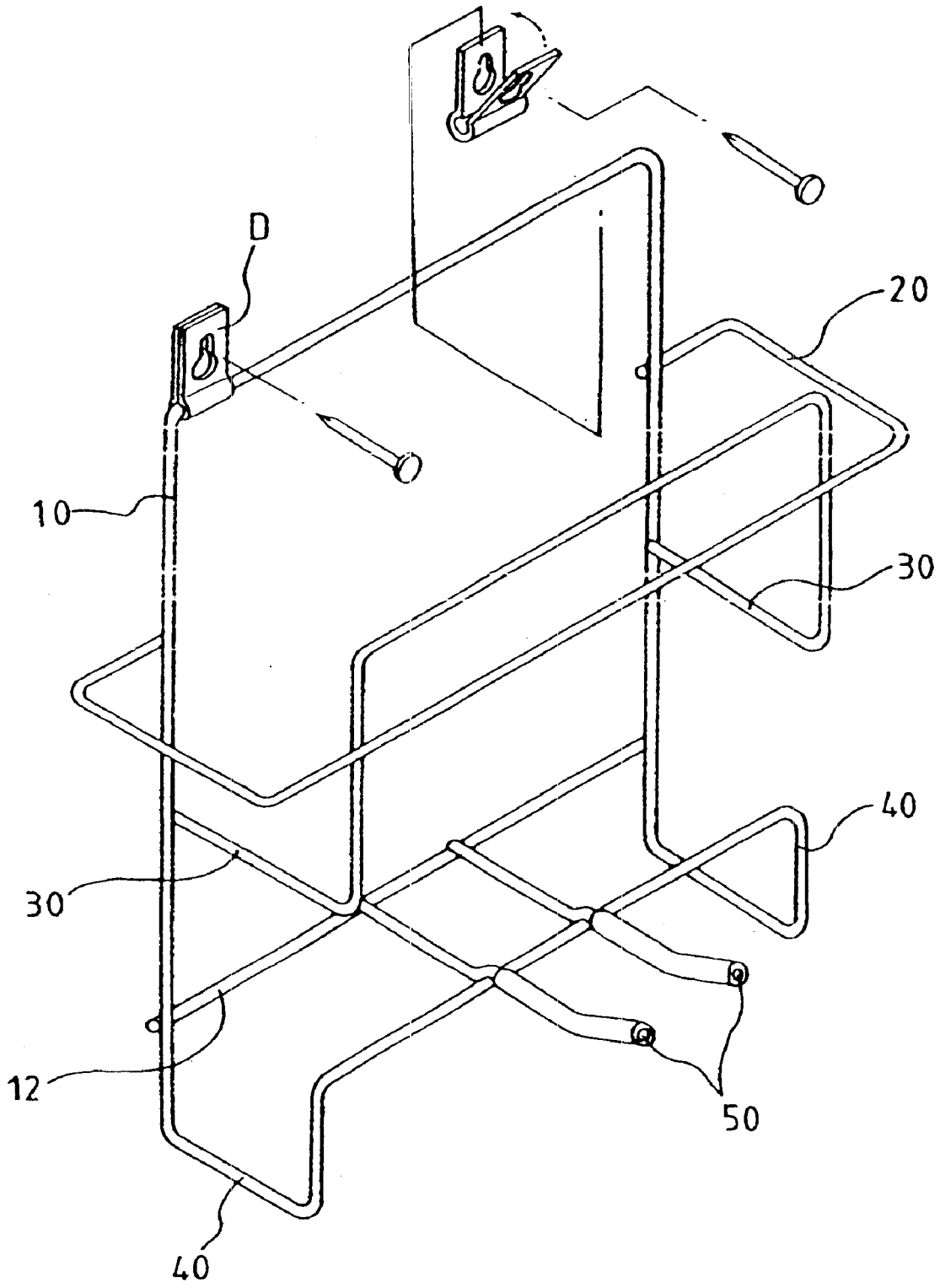

【Fig.2】
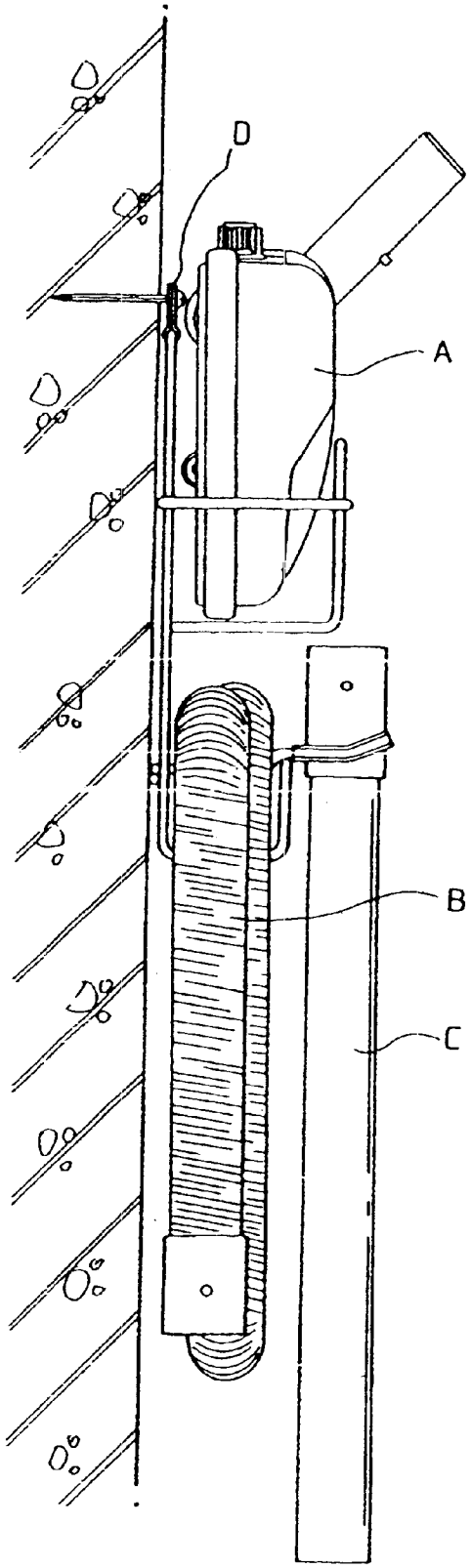

WIRE TYPE APPARATUS FOR HANGING VACUUM CLEANER

BACKGROUND OF THE INVENTION

1. Field of the Invention

The present invention relates to a wire type apparatus for hanging a vacuum cleaner, and in particular to a wire type apparatus for hanging a vacuum cleaner capable of easily storing a vacuum cleaner by fabricating a wire type hanging apparatus in a wall hanged structure.

2. Description of the Background Art

Generally, since the volume of a vacuum cleaner used at home is large, it is difficult to store the vacuum cleaner when it is not used. In particular, since the vacuum cleaner is formed of a plurality of elements such as a wrinkled pipe, a suction port, a connection pipe, etc. connected to a body, when using the vacuum cleaner, the above-described elements are assembled, and when not using the same, the above-described elements are disassembled and stored. The wrinkled pipe is wound on the body of the vacuum cleaner.

However, the vacuum cleaner has a large volume and is hard, so that it is not easily folded and stored. In order to overcome the above problems, a box shaped casing is provided for storing the wrinkled pipe and other parts of the vacuum cleaner, and then the body of the vacuum cleaner is placed thereon. However, in the above-described vacuum cleaner, it is possible to easily store the wrinkled pipe and other parts of the vacuum cleaner. However, since the volume of the box shaped casing is too large, it is difficult to store the vacuum cleaner based on a limited space.

SUMMARY OF THE INVENTION

Accordingly, it is an object of the present invention to provide a wire type apparatus for hanging a vacuum cleaner which overcomes the problems encountered in the conventional vacuum cleaner.

It is another object of the present invention to provide a wire type apparatus for hanging a vacuum cleaner capable of easily storing a vacuum cleaner and other parts of the same.

To achieve the above objects, there is provided a wire type apparatus for hanging a vacuum cleaner, according to the present invention, which includes a main wire having a wall hanger clip at a certain portion and bent to form a body and including a hanging member for hanging a corrugated hose at a lower portion of the body, a skirt wire welded to a certain portion of the main wire and bent to form a certain space for receiving a surrounding portion of the vacuum cleaner, a support wire for supporting the skirt wire and a lower portion of the suction head at a lower portion of the skirt wire, and a connection pipe holder having an end portion connected to a reinforced wire of the main wire and connected with the hanging member, for supporting the connection pipe.

BRIEF DESCRIPTION OF THE DRAWINGS

The present invention will become better understood with reference to the accompanying drawings which are given only by way of illustration and thus are not limitative of the present invention, wherein;

FIG. 1 is a perspective view illustrating an apparatus for hanging a vacuum cleaner according to the present invention; and FIG. 2 is a side view illustrating a state that a vacuum cleaner is hanged to a hanging apparatus according to the present invention.

DETAILED DESCRIPTION OF THE PREFERRED EMBODIMENTS

The embodiments of the present invention will be explained with reference to the accompanying drawings.

FIG. 1 is a view illustrating an apparatus for hanging a vacuum cleaner, according to the present invention. The apparatus is formed by bending and welding a hard wire. The connections of each element are implemented based on a welding method. In the drawings, reference numeral 10 represents a main wire which forms a frame of an apparatus or device for hanging a vacuum cleaner from a wall or other support, reference numeral 20 represents a skirt wire which surrounds the suction head of a vacuum cleaner like a wall and supports the suction head in all directions, reference numeral 30 represents a support wire which supports the head or body of the vacuum cleaner in opposition to the force of gravity and thus prevents the head or body of the vacuum cleaner from being dropped, reference numeral 40 represents a hanging member which supports a corrugated vacuum cleaner hose in a wound state, and reference numeral 50 represents a pipe hanging member or holder which supports the connection pipe which is connected to the corrugated hose.

The construction and operation of the wire hanging member according to the present invention will be explained in detail.

One forms main wire 10 into a substantially vertically oriented frame or hanger body by extending and bending the wire in horizontal and vertical directions. In addition, one or more clips D are engaged to the upper portion for fixing the main wire 10 to the wall using a respective nail or a screw 22. A hanging member 40 is integrally installed at a lower portion of the main wire 10 for hanging a wrinkled pipe or corrugated vacuum cleaner hose B. Hanging member 40 includes a pair of spaced U-shaped brackets 41 and 42 interconnected by an elongate horizontal segment 43 and disposed in respective auxiliary planes oriented at a substantial angle to the main plane of the wall mounted vacuum cleaner hanger device. In the drawings, reference numeral 12 represents a reinforcing wire for providing a lower side of the main wire 10 with support with respect to leftward and rightward torsion forces.

The skirt wire 20 is bent into the form of a loop disposed in a horizontal plane to define a certain space in the horizontal direction on the main wire 10. This space is formed to receive the suction head or vacuum cleaner body A. Therefore, as shown in FIG. 2, lateral or horizontal movements ofthe suction head A are prevented by the skirt wire 20.

The support wire 30 is fixed at opposite ends to vertical segments 31 and 32 of the main wire 10 and includes a pair of horizontal segments 33 and 34 which extend in the forward direction from the main wire and which are bent at a front portion in an upward direction to form a downwardly facing U-shaped section 35 welded to the skirt wire 20 at points spaced from the vertical main plane of the hanger body. Therefore, the suction head A is supported against gravity by horizontal segments 33 and 34.

A connection pipe C which connects the suction head A and the corrugated hose B is suspended from the pipe holder 50, and two elongate hanging members 51 and 52 of holder 50 are connected with the reinforced wire 12 and are welded to the horizontal wire segment 43 of hanging member 40 and include a certain length extended in a forward direction. When the connection pipe C is inserted between the hanging members 51 and 52, a portion having a larger diameter is engaged thereto.

In the storage of a vacuum cleaner, the suction head A which is a part of the vacuum cleaner is inserted into the space defined by the main wire 10, the skirt wire 20, and the support wire 30, as shown in FIG. 2, and the corrugated hose B is wound on the hanging member 40 for thereby easily storing the same. In addition, the connection pipe C is hung between the hanging members 51 and 52.

As described above, the wall mounted type apparatus according to the present invention for hanging a vacuum cleaner is capable of easily storing the suction head A, corrugated hose B and connection pipe C of the vacuum cleaner on a wall and implementing a simplified arrangement and convenient use of the vacuum cleaner.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A wire type device for hanging a vacuum cleaner, comprising:

a main wire having a wall hanger clip and bent to form a body including a hanging member disposed in a lower region of said body for hanging a flexible vacuum cleaner hose, said hanging member including two opposed U-shaped bracket portions connected to one another on one side by said body of said main wire and on an opposite side by an elongate wire segment;

a skirt wire welded to said main wire and bent to form a space for receiving and surrounding a vacuum cleaner suction head;

a support wire welded to said main wire and connected to said skirt wire for supporting said skirt wire and a lower portion of the vacuum cleaner suction head under said skirt wire; and a vacuum cleaner connection pipe holder having an end portion connected to a reinforcing wire welded to said main wire, said holder being connected to said hanging member.

2. The device defined in claim 1 wherein said body is located in a main plane, said skirt wire defining another plane oriented at a substantial angle to said main plane.

3. The device defined in claim 2 wherein said main wire includes two vertical segments defining opposite sides of said body, said skirt wire being connected to said vertical segments.

4. The device defined in claim 3 wherein said skirt wire is connected at one end to one of said vertical segments and at an opposite end to the other of said vertical segments.

5. The device defined in claim 4 wherein said support wire is connected to said vertical segments at points below said another plane and is connected to said skirt wire at points spaced from said main plane.

6. The device defined in claim 5 wherein said support wire includes two horizontal segments each extending from a respective one of said vertical segments, said support wire further including a downwardly open U-shaped portion connected to said horizontal segments, said downwardly open U-shaped portion being connected to said skirt wire.

7. The device defined in claim 5 wherein said pipe holder includes a pair of wire segments each extending substantially perpendicularly to said main plane, each connected at one end to said reinforcing wire and each connected to said elongate wire segment of said hanging member.

8. The device defined in claim 1 wherein said body is located in a main plane and wherein said skirt wire projects from said main plane to define another plane oriented at a substantial angle to said main plane.

9. The device defined in claim 8 wherein said skirt wire is in the form of a loop located in said another plane.

10. The device defined in claim 9 wherein said main wire includes two vertical segments defining opposite sides of said body, said skirt wire being connected to said vertical segments.

11. The device defined in claim 10 wherein said skirt wire is connected at one end to one of said vertical segments and at an opposite end to the other of said vertical segments.

12. A wire type device for hanging a vacuum cleaner, comprising:

a main wire having a wall hanger clip and bent to form a body including a hanging member disposed in a lower region of said body for hanging a flexible vacuum cleaner hose;

a skirt wire welded to said main wire and bent to form a space for receiving and surrounding a vacuum cleaner suction head;

a support wire welded to said main wire and connected to said skirt wire for supporting said skirt wire and a lower portion of the vacuum cleaner suction head under said skirt wire; and a vacuum cleaner connection pipe holder having an end portion connected to a reinforcing wire welded to said main wire, said holder being connected to said hanging member, said support wire being connected to said skirt wire at points spaced from said main plane.

13. A wire type device for hanging a vacuum cleaner, comprising:

a main wire having a wall hanger clip and bent to form a body including a hanging member disposed in a lower region of said body for hanging a flexible vacuum cleaner hose;

a skirt wire welded to said main wire and bent to form a space for receiving and surrounding a vacuum cleaner suction head;

a support wire welded to said main wire and connected to said skirt wire for supporting said skirt wire and a lower portion of the vacuum cleaner suction head under said skirt wire; and a vacuum cleaner connection pipe holder having an end portion connected to a reinforcing wire welded to said main wire, said holder being connected to said hanging member, said support wire including two wire segments extending from opposite sides of said body, said support wire further including a downwardly open U-shaped portion connected to said wire segments, said downwardly open U-shaped portion being connected to said skirt wire.

14. The device defined in claim 1 wherein said pipe holder includes a pair of wire segments each extending substantially perpendicularly to said main plane, each connected at one end to said reinforcing wire and each connected to said hanging member.

15. A wire type device for hanging a vacuum cleaner, comprising:

a main wire having a wall hanger clip and bent to form a body defining a main plane, said body being disposable against a wall, said body including a hanging member disposed in a lower region of said body for hanging a flexible vacuum cleaner hose, said hanging member including a pair of spaced U-shaped portions disposed in respective auxiliary planes oriented at a substantial angle to said main plane;

a skirt wire welded to said main wire and taking the form of a loop extending from said main plane in an additional plane oriented at a substantial angle to said main plane and at a substantial angle to said auxiliary planes to thereby define a space for receiving and surrounding a vacuum cleaner suction head;

a support wire welded to said main wire at points spaced from said additional plane and connected to said skirt wire for supporting said skirt wire and a lower portion of the vacuum cleaner suction head; and a vacuum cleaner connection pipe holder having an end portion connected to said main wire and to said hanging member.

16. The device defined in claim 15 wherein said support wire includes two wire segments extending from opposite sides of said body, said support wire further including a downwardly open U-shaped portion connected to said wire segments, said downwardly open U-shaped portion being connected to said skirt wire.

17. The device defined in claim 15, further comprising a reinforcing wire connected across said body, said pipe holder including a pair of wire segments each extending substantially perpendicularly to said main plane, each connected at one end to said reinforcing wire and each connected to said hanging member.

* * * * *